US009487969B2

(12) United States Patent
Lai

(10) Patent No.: US 9,487,969 B2
(45) Date of Patent: Nov. 8, 2016

(54) COMBINATION PADLOCK WITH ANTI-PICK AND ANTI-PEEK MECHANISM

(71) Applicant: The Sun Lock Company Ltd., Tuen Mun, N.T. (HK)

(72) Inventor: Karl Lai, Tai Po (HK)

(73) Assignee: The Sun Lock Company Ltd., Tuen Mun, N.T. (HK)

( * ) Notice: Subject to any disclaimer, the term of this patent is extended or adjusted under 35 U.S.C. 154(b) by 0 days.

(21) Appl. No.: 14/824,379

(22) Filed: Aug. 12, 2015

(65) Prior Publication Data

US 2016/0102476 A1 Apr. 14, 2016

Related U.S. Application Data

(60) Provisional application No. 62/062,253, filed on Oct. 10, 2014.

(51) Int. Cl.

| | |
|---|---|
| ***E05B 37/02*** | (2006.01) |
| ***E05B 37/00*** | (2006.01) |
| *E05B 67/22* | (2006.01) |

(52) U.S. Cl.

CPC ..... *E05B 37/0058* (2013.01); *E05B 37/0048* (2013.01); *E05B 37/025* (2013.01); *E05B 67/22* (2013.01)

(58) Field of Classification Search

CPC .. E05B 37/00; E05B 3/0048; E05B 37/0058; E05B 37/02; E05B 37/025; E05B 67/00; E05B 67/02; E05B 67/06; E05B 67/22

See application file for complete search history.

(56) References Cited

U.S. PATENT DOCUMENTS

| | | | | |
|---|---|---|---|---|
| 4,444,029 A * | 4/1984 | Remington | ..... | E05B 37/025 70/25 |
| 4,733,548 A * | 3/1988 | Ling | ..... | E05B 37/025 70/25 |
| 4,829,794 A * | 5/1989 | Crown | ..... | E05B 37/02 70/25 |

(Continued)

FOREIGN PATENT DOCUMENTS

| | | |
|---|---|---|
| EP | 2738326 | 6/2014 |
| GB | 2493266 | 1/2013 |

(Continued)

OTHER PUBLICATIONS

Search Report issued by the GB Intellectual Property Office on Mar. 15, 2016 in counterpart GB application No. GB1516376.9 (1 page).

(Continued)

*Primary Examiner* — Christopher Boswell

(74) *Attorney, Agent, or Firm* — Ware, Fressola, Maguire & Barber LLP

(57) ABSTRACT

A combination lock having a plurality of dials and clutches arranged to control a lock shackle is disclosed. Each of the dials is mounted on a different clutch to form a dial-clutch pair. The clutch has a protrusion and the dial has an open slot dimensioned to receive a protrusion and a plurality of faulty notches. The protrusion is so located that when the lock is in the lock mode, the protrusion in each of the dial-clutch pairs is disengaged from the open slot, allowing the dial to rotate relative to the clutch. Since the clutches do not turn along with the dials and the faulty notches look similar to the open slot, it would be difficult for an intruder to pick the lock by peeking the protrusion of the clutches while rotating the dials.

15 Claims, 7 Drawing Sheets

(56) References Cited

U.S. PATENT DOCUMENTS

| | | | | |
|---|---|---|---|---|
| 5,715,709 | A * | 2/1998 | Lai | E05B 37/025 70/25 |
| 6,029,481 | A | 2/2000 | Lai | |
| 6,176,109 | B1 * | 1/2001 | Tsui | E05B 37/025 70/25 |
| 6,345,523 | B1 * | 2/2002 | Kuo | E05B 37/02 70/312 |
| 6,439,006 | B1 * | 8/2002 | Tsai | E05B 37/025 70/233 |
| 6,474,116 | B1 | 11/2002 | Lai | |
| 6,675,614 | B2 | 1/2004 | Lai | |
| 6,729,166 | B1 * | 5/2004 | Lai | E05B 37/025 70/22 |
| 6,883,355 | B2 | 4/2005 | Lai | |
| 6,904,776 | B1 | 6/2005 | Lin | |
| 7,117,698 | B2 | 10/2006 | Lai | |
| 7,121,123 | B2 | 10/2006 | Yu | |
| 7,140,209 | B2 | 11/2006 | Lai | |
| 7,155,944 | B1 | 1/2007 | Lin | |
| 7,225,648 | B2 | 6/2007 | Lai et al. | |
| 7,370,498 | B1 | 5/2008 | Miao | |
| 7,467,531 | B2 | 12/2008 | Lai et al. | |
| 7,562,545 | B2 | 7/2009 | Lai et al. | |
| 7,685,851 | B2 | 3/2010 | Lai | |
| 7,765,840 | B2 | 8/2010 | Lai et al. | |
| 7,779,658 | B2 * | 8/2010 | Matsushita | E05B 37/025 70/30 |
| 8,261,583 | B2 | 9/2012 | Lai et al. | |
| 8,511,118 | B2 | 8/2013 | Lai et al. | |
| 8,661,861 | B2 | 3/2014 | Lai | |
| 8,776,556 | B2 * | 7/2014 | Lai | E05B 37/025 70/25 |
| 8,881,558 | B2 * | 11/2014 | Misner | E05B 37/025 70/25 |
| 8,919,155 | B2 | 12/2014 | Lai | |
| 8,931,313 | B2 | 1/2015 | Lai | |
| 8,966,946 | B2 * | 3/2015 | Lai | E05B 37/025 70/25 |
| 9,206,625 | B2 | 12/2015 | Lai | |
| 2003/0150245 | A1 | 8/2003 | Lai | |
| 2004/0031298 | A1 | 2/2004 | Lai | |
| 2005/0092036 | A1 | 5/2005 | Lai | |
| 2006/0027000 | A1 | 2/2006 | Yu | |
| 2006/0027001 | A1 | 2/2006 | Lai | |
| 2006/0150690 | A1 | 7/2006 | Lai et al. | |
| 2006/0243005 | A1 | 11/2006 | Lai et al. | |
| 2006/0260369 | A1 | 11/2006 | Lai et al. | |
| 2008/0011025 | A1 | 1/2008 | Lin | |
| 2008/0083251 | A1 | 4/2008 | Lai et al. | |
| 2008/0098774 | A1 | 5/2008 | Huang | |
| 2008/0250825 | A1 | 10/2008 | Lai | |
| 2009/0113947 | A1 | 5/2009 | Lai et al. | |
| 2009/0165507 | A1 * | 7/2009 | Tong | E05B 37/025 70/25 |
| 2012/0304711 | A1 | 12/2012 | Misner et al. | |
| 2013/0025333 | A1 | 1/2013 | Lai | |
| 2013/0036778 | A1 | 2/2013 | Lai | |
| 2013/0118215 | A1 | 5/2013 | Lai | |
| 2014/0026626 | A1 | 1/2014 | Lai | |
| 2014/0250952 | A1 | 9/2014 | Lai | |
| 2014/0352371 | A1 | 12/2014 | Lai | |
| 2014/0366592 | A1 | 12/2014 | Bao et al. | |
| 2014/0373579 | A1 | 12/2014 | Lai | |
| 2015/0322692 | A1 | 11/2015 | Lai | |
| 2015/0330104 | A1 | 11/2015 | Lai | |

FOREIGN PATENT DOCUMENTS

| | | |
|---|---|---|
| GB | 2498242 | 7/2013 |
| GB | 2519128 | 4/2015 |

OTHER PUBLICATIONS

Examination Report issued by the GB Intellectual Property Office on Mar. 15, 2016 in counterpart GB application No. GB1516376.9 (4 pages).

* cited by examiner

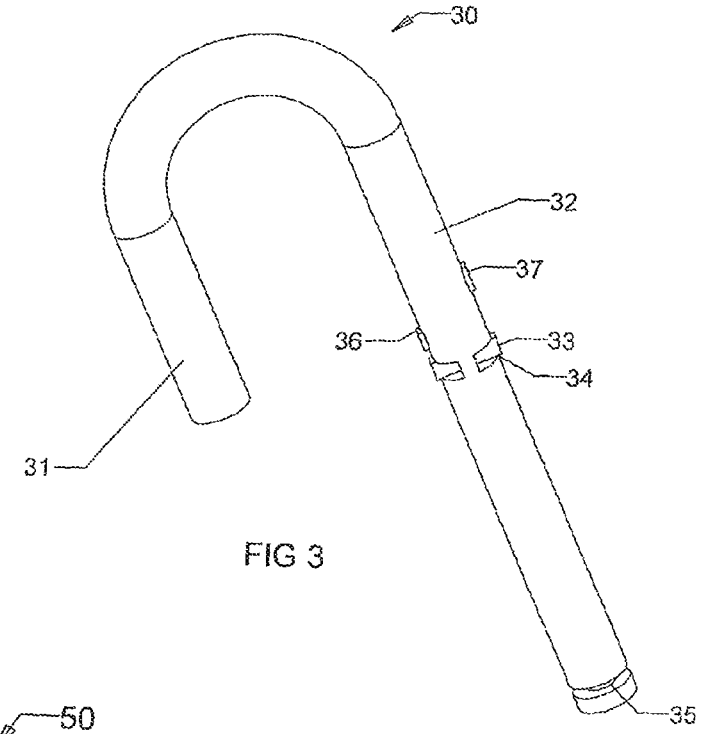
FIG 3
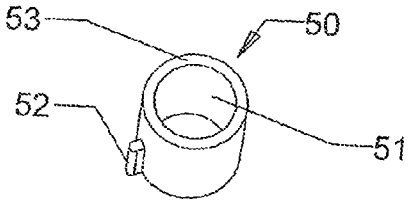
FIG 5
FIG 6
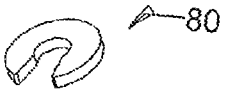
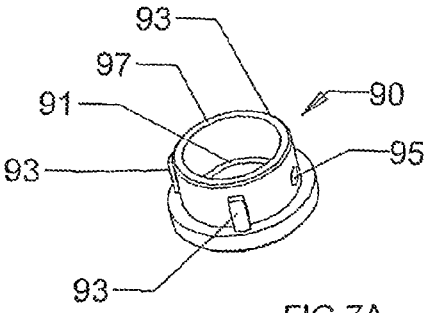
FIG 7A
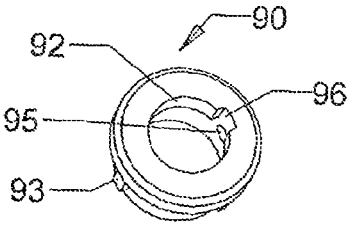
FIG 7B

COMBINATION PADLOCK WITH ANTI-PICK AND ANTI-PEEK MECHANISM

CROSS REFERENCE TO RELATED APPLICATION

This application claims priority to a application Ser. No. 62/062,253, filed Oct. 10, 2014, which application is hereby incorporated by reference in its entirety.

TECHNICAL FIELD

This invention relates to combination locks and, more particularly, to combination locks constructed to virtually eliminate the ability of an unauthorized person to pick the lock.

BACKGROUND OF THE INVENTION

Numerous lock constructions have been developed and are widely used by individuals to prevent unauthorized persons from gaining access to an area which has been closed and locked. One particular type of combination lock that has become very popular due to its ease and convenience of use is a combination lock which employs a plurality of rotatable independent dials, each of which forms one of the indicia, usually numerals or letters, to form the combination code for releasing the lock.

Currently some of the locks have a plurality of false void zones in a lock housing in association with the tumbler release channel intended to thwart unwanted opening of the combination lock. However, the existing designs have a drawback of allowing an intruder to try to fiddle the combination and open the padlock.

SUMMARY OF THE INVENTION

The present invention is directed toward a combination lock having a plurality of dials and clutches arranged to control a lock shackle based on a combination code. Each of the dials is mounted on a different clutch to form a dial-clutch pair. The clutch has a protrusion and the dial has an open slot dimensioned to receive a protrusion and a plurality of faulty notches. The protrusion is so located that when the lock is in the lock mode, the protrusion in each of the dial-clutch pairs is disengaged from the open slot, allowing the dial to rotate relative to the clutch. Since the clutches do not turn along with the dials and the faulty notches look similar to the open slot, it would be difficult for an intruder to pick the lock by peeking the protrusion of the clutches while rotating the dials.

Thus, one aspect of the present invention is a combination lock operable at least in a lock mode and an open mode, the combination lock comprising:

a lock body;

a shackle having a long leg and a short-leg;

a stack of clutches, each clutch having a hole defining an inner surface and a protrusion on an outer surface, the hole arranged to receive the long leg of the shackle; and a plurality of dials rotatably mounted on the stack of the clutches to form a combination code, each of the dials arranged to mount on a different one of the clutches to form a dial-clutch pair, wherein the lock body comprises a body portion to house the long leg of the shackle and a lock hole spaced from the body portion arranged to receive the short leg of the shackle when the lock is operated in the lock mode, the body portion comprising a plurality of separation sections and a plurality of gaps separating the separation sections, wherein each of the gaps and one of the adjacent separation sections are associated with a dial-clutch pair, and wherein the dial comprises an inner ring, the inner ring having an inner diameter to receive the clutch and an open slot dimensioned to receive the protrusion of the clutch at least when the lock is operated in the open mode.

According to an embodiment of the present invention, in each of the dial-clutch pairs, the clutch has a first segment and a second segment having the protrusion, and when the lock is in the lock mode, the dial is located in the first segment of the clutch such that the protrusion of the clutch is effectively disengaged from the dial, allowing the dial to rotate relative to the clutch.

According to an embodiment of the present invention, the gap is dimensioned to accommodate a dial, and the separation section comprises a channel dimensioned to receive a clutch such that, in each of the dial-clutch pairs, the first segment of the clutch is located in the gap and the second segment of the clutch is located in the separation section when the lock is operated in the lock mode.

According to an embodiment of the present invention, the long leg of the shackle has a longitudinal axis and wherein the channel comprises a plurality of channel notches, such that the protrusion of the clutch is at least partly located in one of the channel notches when the lock is operated in the lock mode or operated in the open mode, preventing the clutch from being rotated about the longitudinal axis of the long leg of the shackle.

According to an embodiment of the present invention, the dial has a thickness and the open slot is made through the thickness, and wherein the dial further comprises on the inner ring a plurality of dial notches facing the second segment of the clutch, each dial notch having a notch length smaller than the thickness, wherein each of the dial notches is arranged to align with a channel notch of the channel in the separation section where the second segment of the clutch is located.

According to an embodiment of the present invention, the long leg of the shackle comprises a shackle end and a limiting protrusion spaced from the shackle end, the limiting protrusion is so located as to accommodate said stack of clutches between the limiting protrusion and the shackle end such that the stack of clutches is caused to move along the shackle when the long leg of the shackle is caused to move along the longitudinal axis. According to an embodiment of the present invention, when the lock is operated in the lock mode, the protrusion of the clutch in at least one of the dial-clutch pairs is misaligned from the open slot of the dial.

According to an embodiment of the present invention, the body portion has a first end and an opposing second end adjacent to the shackle end of the long leg of the shackle, and wherein when the shackle is caused to move in a first direction along the longitudinal axis away from the second end of the body portion when the lock is operated in the lock mode, the protrusion of the clutch in said at least one of the dial-clutch pairs is caused to move into one of the dial notches of the dial, preventing the dial from rotating relative to the clutch.

According to an embodiment of the present invention, when the protrusion of the clutch in each of the dial-clutch pairs is aligned with the open slot of the dial, the protrusion can be caused to move into the open slot such that the long leg of the shackle can be caused to make a movement in the first direction to cause the short leg of the shackle to disengage from the lock hole of the lock body, prompting the lock to operate in the open mode.

According to an embodiment of the present invention, the lock body further comprises a cap located on the first end of the body portion, the cap comprising a partial ring dimensioned to receive the long leg of the shackle, the partial ring having a ring surface facing the second end of the body portion, and wherein the long-leg of the shackle further comprises a reset-protrusion adjacent to the limiting protrusion further away from the shackle end, the reset-protrusion is arranged such that when the lock is operated in the open mode, the movement of the long-leg of the shackle in the first direction is limited by contacting between the reset-protrusion of the shackle and the ring surface of the partial ring, thereby preventing the protrusions of the clutches from disengaging from the channel notches.

According to an embodiment of the present invention, the partial ring further comprises a ring slot dimensioned to receive the reset-protrusion of long leg of the shackle, and wherein, when the lock is operated in the open mode, the long leg of the shackle can be caused to rotate about the longitudinal axis so as to align the reset-protrusion with the ring slot of the partial ring such that the long leg of the shackle can be caused to make a further movement in the first direction to allow the protrusions of the clutches to disengage from the channel notches.

According to an embodiment of the present invention, when the protrusions of the clutches are disengaged from the channel notches, the dials together with the clutches can be caused to rotate independently for changing the combination code.

According to an embodiment of the present invention, the first end of the body portion further comprises a plurality of first end notches, and the cap further comprises one or more keys dimensioned for insertion into one or more first end notches so as to locate the ring slot on the first end of the body portion.

According to an embodiment of the present invention, the long-leg of the shackle further comprises an alignment protrusion adjacent to the reset-protrusion further away from the limiting protrusion, the alignment protrusion is arranged such that when the lock is operated in the lock mode, the alignment protrusion is located in the ring slot of the partial ring, and when the long leg of the shackle is caused to make the movement in the first direction to disengage the short leg of the shackle from the lock hole of the lock body, the movement in the first direction also releases the alignment protrusion from the ring slot of the partial ring.

According to an embodiment of the present invention, wherein after the protrusions of the clutches have been disengaged from the channel notches, the long leg of the shackle is prevented from moving a second direction opposite to the first direction unless the alignment protrusion of the long leg of the shackle is aligned with the ring slot of the partial ring.

BRIEF DESCRIPTION OF THE DRAWINGS

FIG. 3 is an isometric view of the shackle.

FIG. 5 is an isometric view of a clutch.

FIG. 6 is an isometric view of a C-clip.

FIG. 7A is an isometric view of the top sealing cap showing the bottom of the cap.

FIG. 7B is an isometric view of the top sealing cap showing the top of the cap.

DETAILED DESCRIPTION

Figure 1A:
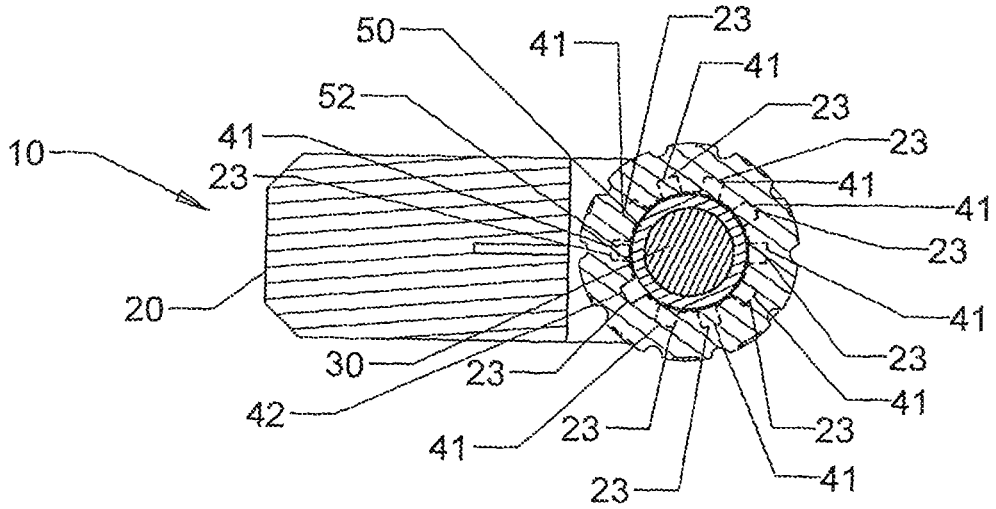
FIG. 1A is a cross sectional plan view of the lock body showing a dial, the long-leg of the shackle, and a clutch when the protrusion of the clutch is misaligned with the open slot of the dial.
Figure 4A:
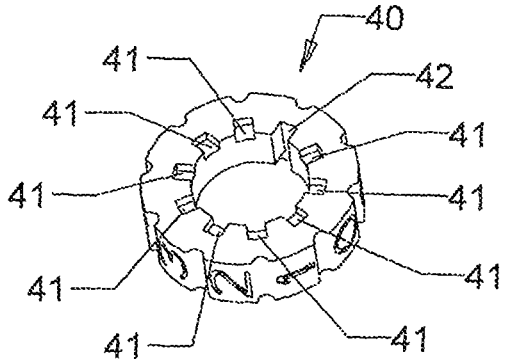
FIG. 4A is an isometric view of a dial showing the bottom of the dial.
Figure 4B:
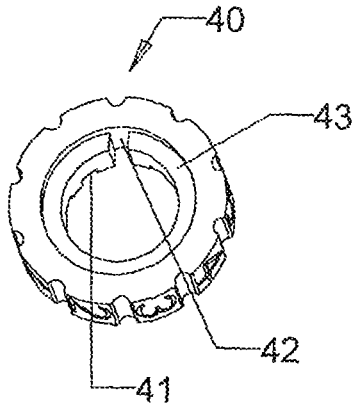
FIG. 4B is an isometric view of a dial showing the top of the dial.

In a combination lock, there are a number of clutches and an equal number of dials in a lock body such that each dial is mounted over a clutch. In the existing combination lock, when the lock is in the lock mode, the clutches turn along with the dials. As such, a combination lock may be picked by an intruder who peeks the protrusion of the clutches during the rotation of the dials.

The combination lock, according to an embodiment of the present invention, the clutches and the dials are arranged such that the clutches do not turn along with the dials when the lock is in the lock mode.

As can be seen in FIGS. 1A-9B, the combination lock 10 has a lock body 20 to engage with a shackle 30. The shackle 30 has a long leg 32 and a short leg 31. One portion of the lock body 20 has a plurality of separation sections 24 and a top section 27. The top segment 27 and the separation sections 24 each having an opening or channel 22 with notches or channel notches 23 to accommodate a number of clutches 50. The lock body 20 also has a plurality of gaps 28 to receive an equal number of dials 40. Each of the dials 40 is mounted over a clutch 50 to form a dial-clutch pair. The adjacent gaps 28 are separated by a separation section 24, such that each of the gaps 28 and an adjacent separation section 24 are associated with one of the dial-clutch pairs. All the openings 22 on the top segment 27 and the separation sections 24 are aligned to define a rotational axis (FIG. 2B) which is substantially coincidental to the longitudinal axis of the long leg 32 of the shackle 30. Each of the clutches 50 has a protrusion 52 which is located in one of the notches 23 when the lock is in the lock mode or in the open mode. When a protrusion 52 is located in a notch 23, the clutch 50 is prevented from turning relative to the shackle 30. That is, the clutch 50 is prevented from rotating about the rotational axis. Each of the clutches 50 has a hole 51 to receive the long leg 32 of the shackle 30 and allow the shackle 30 to rotate when the lock is in the open mode. The shackle 30 has a limiting protrusion 33 and a neck cut-out 35. The neck cut-out 35 is located near the end of the long leg shackle 32 and dimensioned to receive a clip, such as C-clip 80, such that the clutches 50 are stacked between the lower edge 34 of the limiting protrusion 33 and the C-clip 80. The protrusion 52 of the clutch 50 has a length such that, when the lock is in the lock mode, the protrusion 52 is substantially located in the separation section 24. As such, in each of the dial-clutch pairs, the dial 40 is located on the top segment of the clutch 50 and disengaged from the protrusion 52, allowing the dial 40 to turn relative to the clutch 50. Thus, in the lock mode, the clutches 50 do not turn along with the dials 40.

After all the dials 40, the clutches 50 and the shackle 30 are assembled in the lock body 20, a top sealing cap 90 is put on top of the opening 22 of the top segment 27 of the lock body 20. The top sealing cap 90 has a sealing hole 95 aligned with a hole 25 near the top of the top segment 27 (see FIG. 2B). A pin 100 is inserted into the hole 25 of the lock body 20 and the sealing hole 95 of the top sealing cap 90 to hold the sealing cap 90 on the lock body 20.

The top sealing cap 90 has a partial ring 92 with a ring surface 91 and a ring slot 96. The shackle 30 has an alignment protrusion 37 arranged to engage with the ring slot 96 on the partial ring 92 of the top sealing cap 90 when the lock is in the lock mode. As shown in FIGS. 7A and 7B, the top sealing cap 90 has a plurality of keys 93 to be inserted into the notches 23 of the top section 27 so as to fix the location of the ring slot 96 relative to the lock body 20.

Figure 1B:
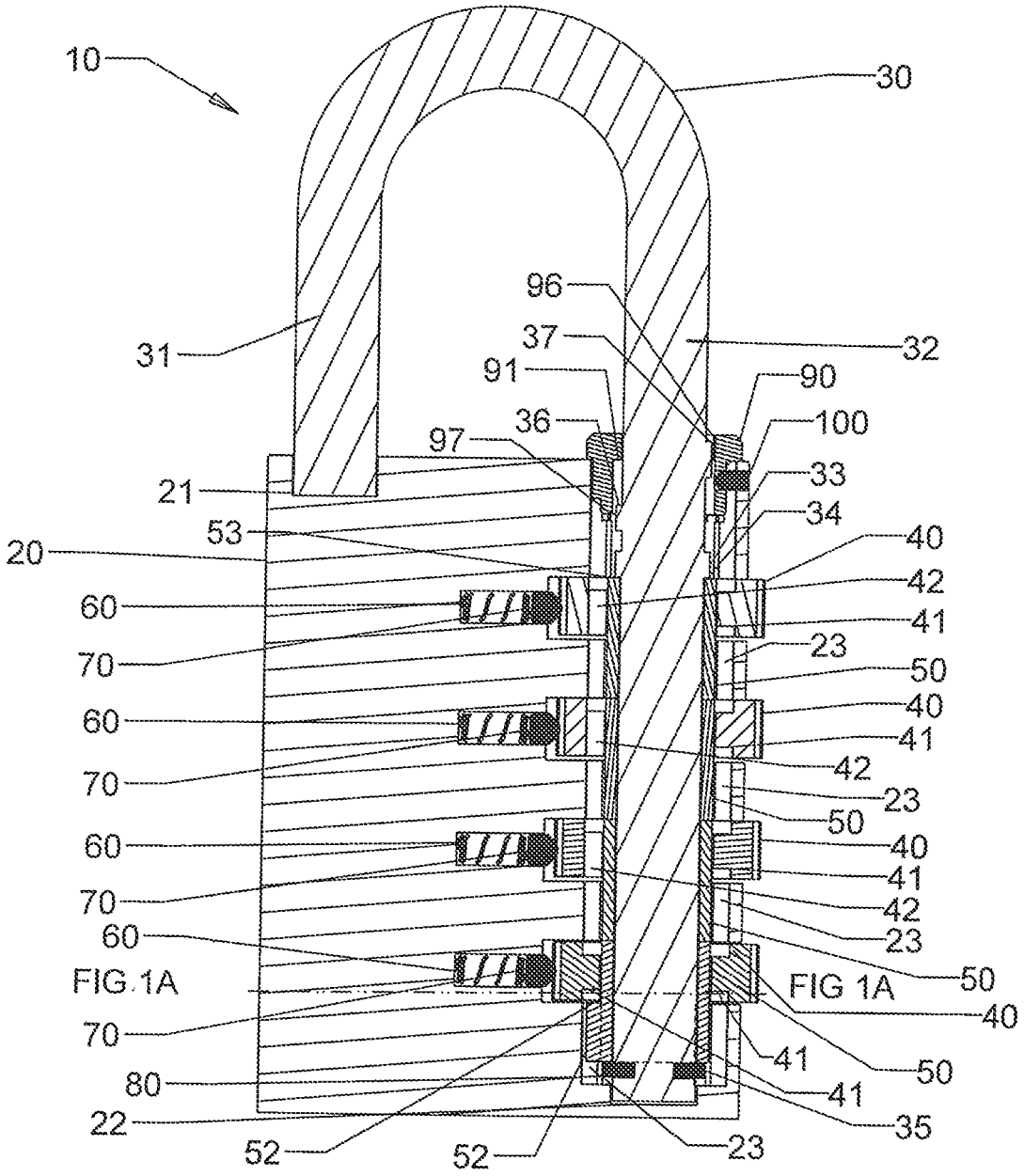
FIG. 1B is a cross sectional front view of the lock showing the shackle located in the lock body when the lock is in the lock mode.
Figure 2A:
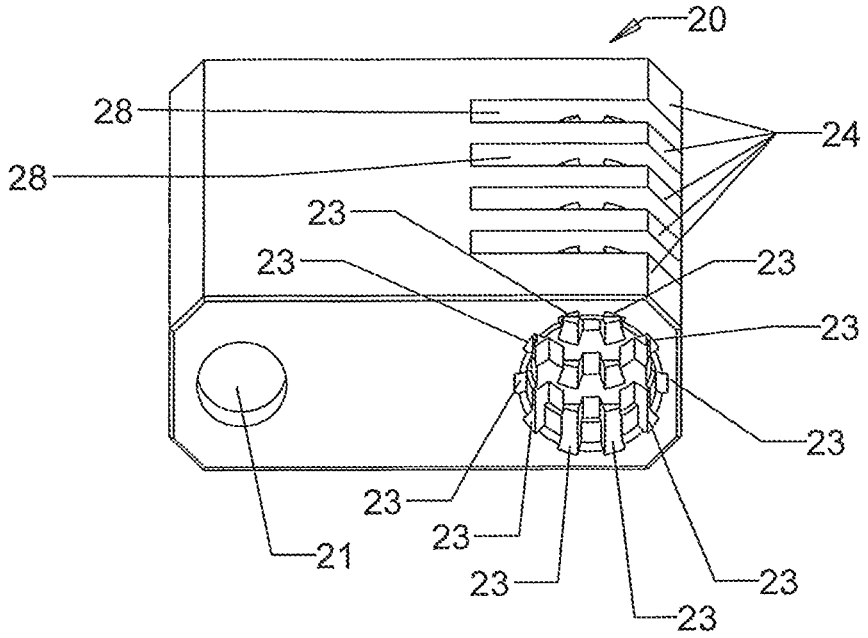
FIG. 2A is an isometric view of the lock body showing the top part of the lock body.
Figure 2B:
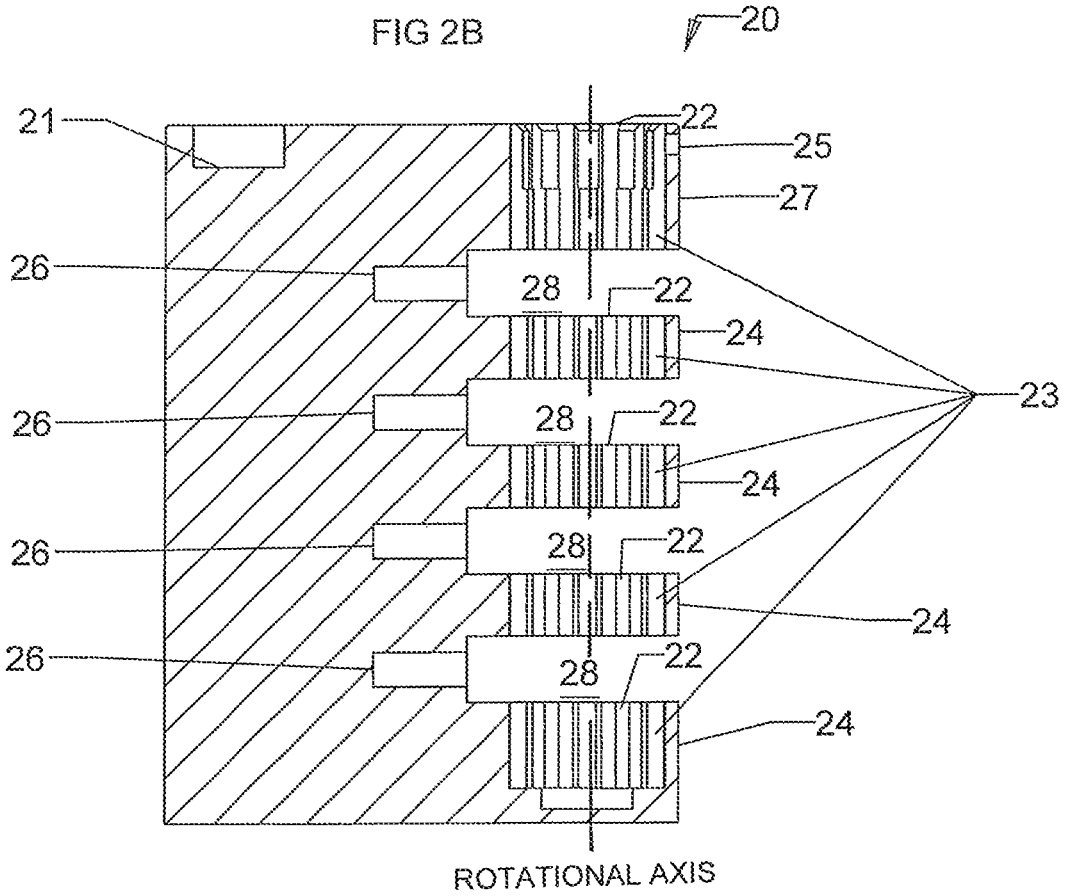
FIG. 2B is a cross sectional front view of the lock body showing the notches in the separation sections.

As shown in FIG. 2B, at the end of each of the gaps 28, there is a cavity 26. Each of the cavities 26 has a spring 60 and a pin 70 to engage with the outer surface of a dial 40 with an urging force as shown in FIG. 1B.

Lock Mode FIGS. 1A-1B

In the lock mode, the protrusion 52 of each of the clutches 50 is located in one of the notches 23 of the lock body 20. Thus, each of the separation sections 24 of the lock body 20 has at least one notch 23 to receive the protrusion 52 of a clutch 50. For example, the dial 40 shown has ten digits "0-1-2-3-4-5-6-7-8-9" then the each of the separation section 24 of the lock body 20 has ten notches 23 to receive the protrusion 52 of the clutch 50. The clutch 50 shown in this application has at least one protrusion 52, but the number of protrusions can be one, two or more. When a protrusion 52 is located in a notch 23, the clutch 50 is prevented from turning relative to the long leg 32 of the shackle 30 or rotating about the rotational axis (FIG. 2B). The dial 40 has an inner ring 43 having at least one open slot 42 to receive the protrusion 52 of the clutch 50. When the protrusion 52 of the clutch 50 is not aligned with the open slot 42 of the dial 40 in a dial-clutch pair, the clutch 50 has a very limited vertical movement. As the shackle 30 carries a stack of clutches 50 between the limiting protrusion 33 and the C-clip 80, the vertical movement of the shackle 30 is controlled by the protrusion 52 of the clutch 50. Thus, when, at least in one of the dial-clutch pairs, the protrusion 52 of the clutch 50 is not aligned with the open slot 42 of the dial 40, the shackle 30 cannot be pulled upward in order to release the short leg 31 of the shackle 30 from the lock hole 21 of the lock body 20. Hence, the lock is in the lock mode. In the lock mode, the protrusion 52 of each of the clutches 50 is located in a notch 23, which prevents the clutch 50 from turning relative to the long leg 32 of the shackle 30. Thus, in the lock mode, the clutches 50 do not turn along with the dials 40. In other words, the turning of the dials 40 has no effect on the clutches 50. This means that an intruder cannot peek the protrusion 52 of the clutch 50 in an attempt to align all the clutches 50 by turning the clutches 50. Furthermore, the inner ring 43 of the dial 40 has one or more faulty or dial notches 41 (the dial shown in this application has nine faulty notches 41). On each of the dials 40, the faulty notches 41 appear to be similar to the open slot 42, rendering it difficult for an intruder to pick the combination by turning the dials 40.

With the open slot 42 being integrated with the dial 40 and the protrusion 52 of some of the clutches 50 being located inside a notch 23 of the lock body 20 when the lock is in the lock mode, viewing the protrusion 52 of the clutch 50 to pick the combination is very difficult. Furthermore, since the protrusion 52 of a clutch 50 can be in any one the notches 23 in a separation section 24 of the lock body 20, the location of the protrusion 52 is difficult to be figured out in order to align a correct combination for picking. If the intruder pulls the shackle 30 upward to pick the dials 40, the protrusion 52 of at least one clutch 50 would fall into a faulty notch 41 of the dial 40, preventing the dial 40 from rotating relative to the clutch 50. Furthermore, because all the clutches are prevented from turning due to the notches 23, all the dials 40 cannot be rotated as the result of pulling the shackle 30 upward.

Figure 8A:
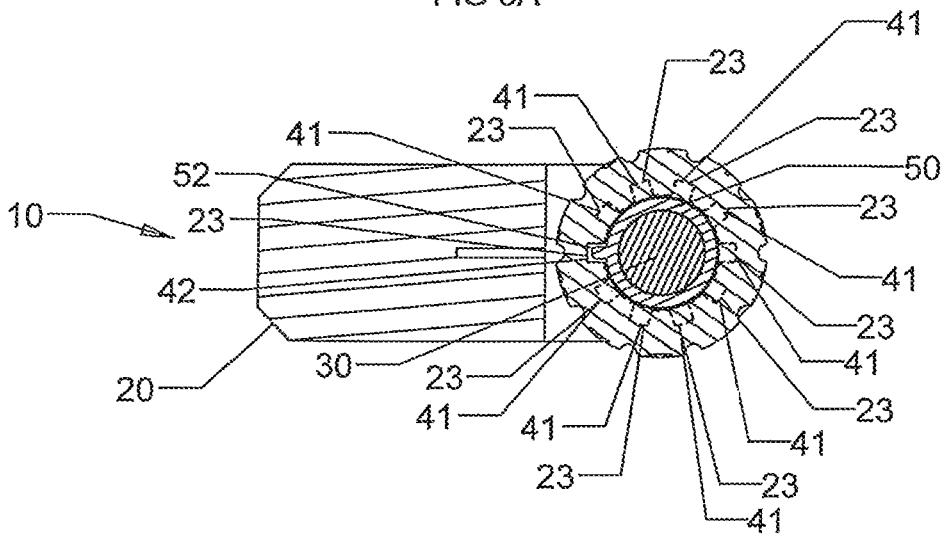
FIG. 8A is a cross sectional plane view of the lock body showing a dial, the long-leg of the shackle, and a clutch as the protrusion of the clutch is aligned with the open slot of the dial when the lock in the open mode.
Figure 8B:
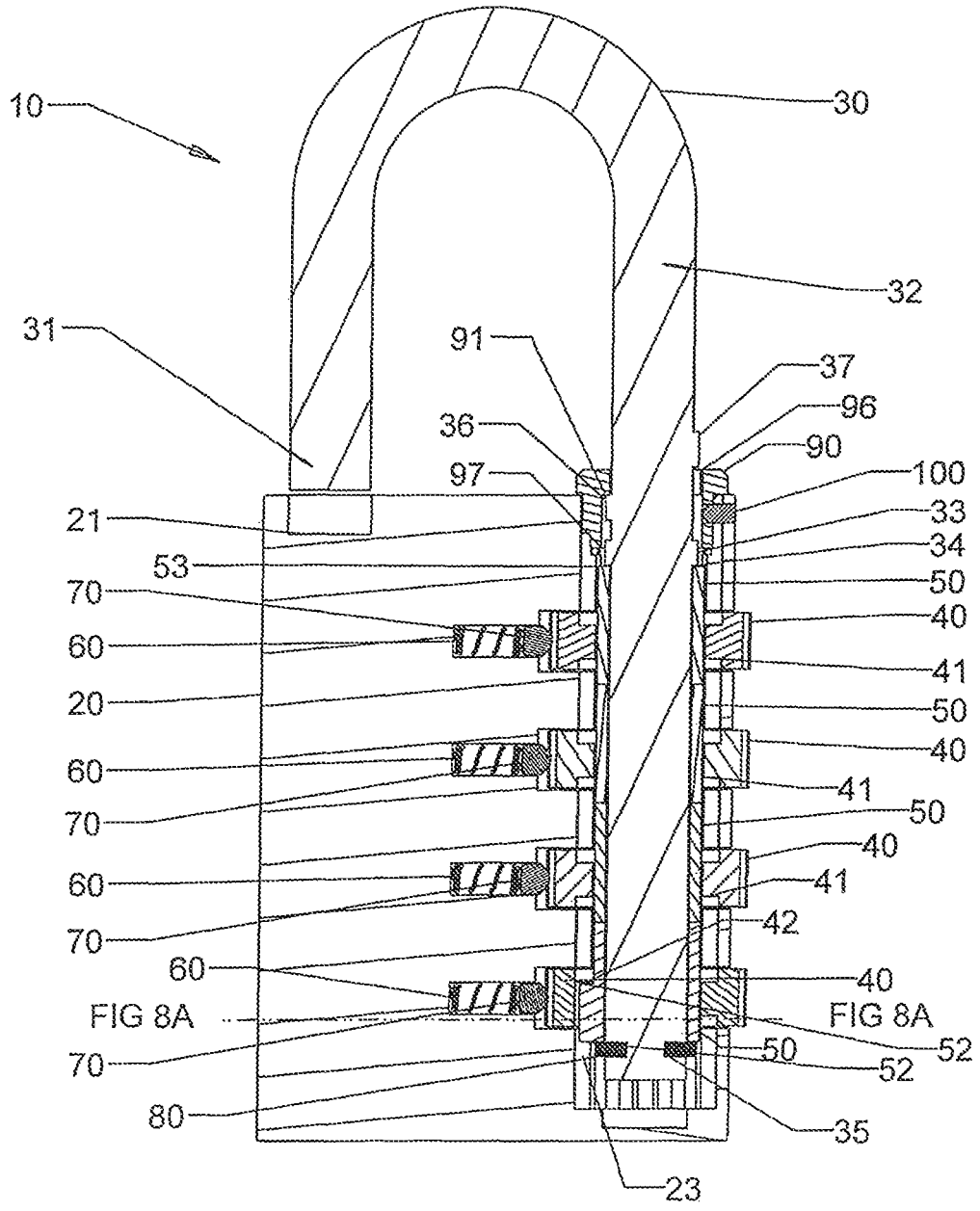
FIG. 8B is a cross sectional front view of the lock showing the shackle located in the lock body when the lock is in an open mode.

Open Mode FIG. 8A-8B:

As the user aligns the open slot 42 of the dial 40 with the protrusion 52 of the clutch 50 in each of the dial-clutch pairs according to the correct combination, the user can pull the long leg 32 of the shackle 30 along with the clutches 50 upward until the reset-protrusion 36 of the shackle 30 contacts the ring surface 91 of the partial ring 92 on the top sealing cap 90. This upward movement would release the short leg 31 of the shackle 30 from the lock hole 21 of the lock body 20. Hence the lock is in the open mode. In the open mode, the protrusion 52 of the clutch 50 is still in the notch 23 of the lock body 20 which prevents the clutch 50 from turning relative to the long leg 32 of the shackle 30. As such, the combination cannot be changed accidently or deliberately when the lock is in the open mode.

Since the protrusion 52 of the clutch 50 of each of the dial-clutch pairs is located inside the open slot 42 of the dial 40, the dials 40 cannot be rotated. In this manner, the user would realize that the lock is in the open mode by the fact that the dials 40 cannot turn.

Figure 9A:
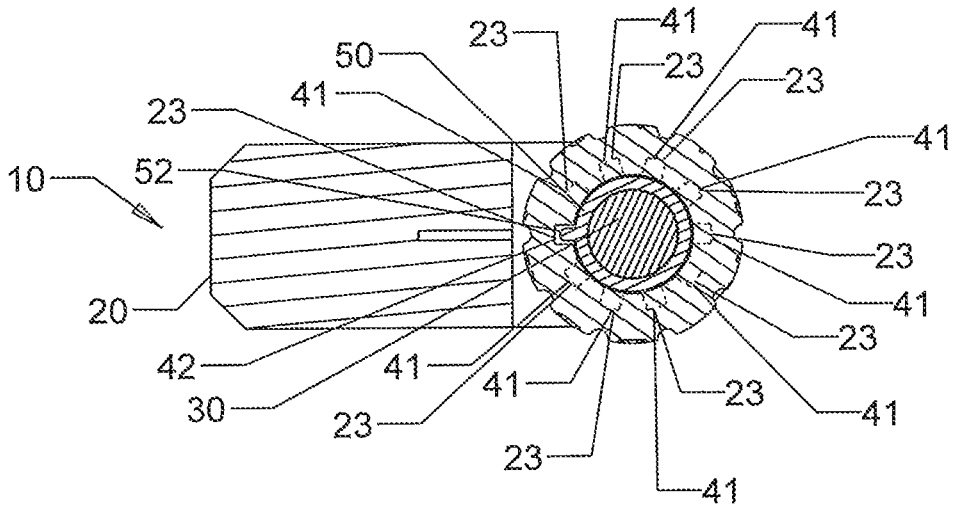
FIG. 9A is a cross sectional plane view of the lock body showing a dial, the long-leg of the shackle, and a clutch on the lock body when the protrusion of the clutch is aligned with the open slot of the dial when the lock is in the rest mode.
Figure 9B:
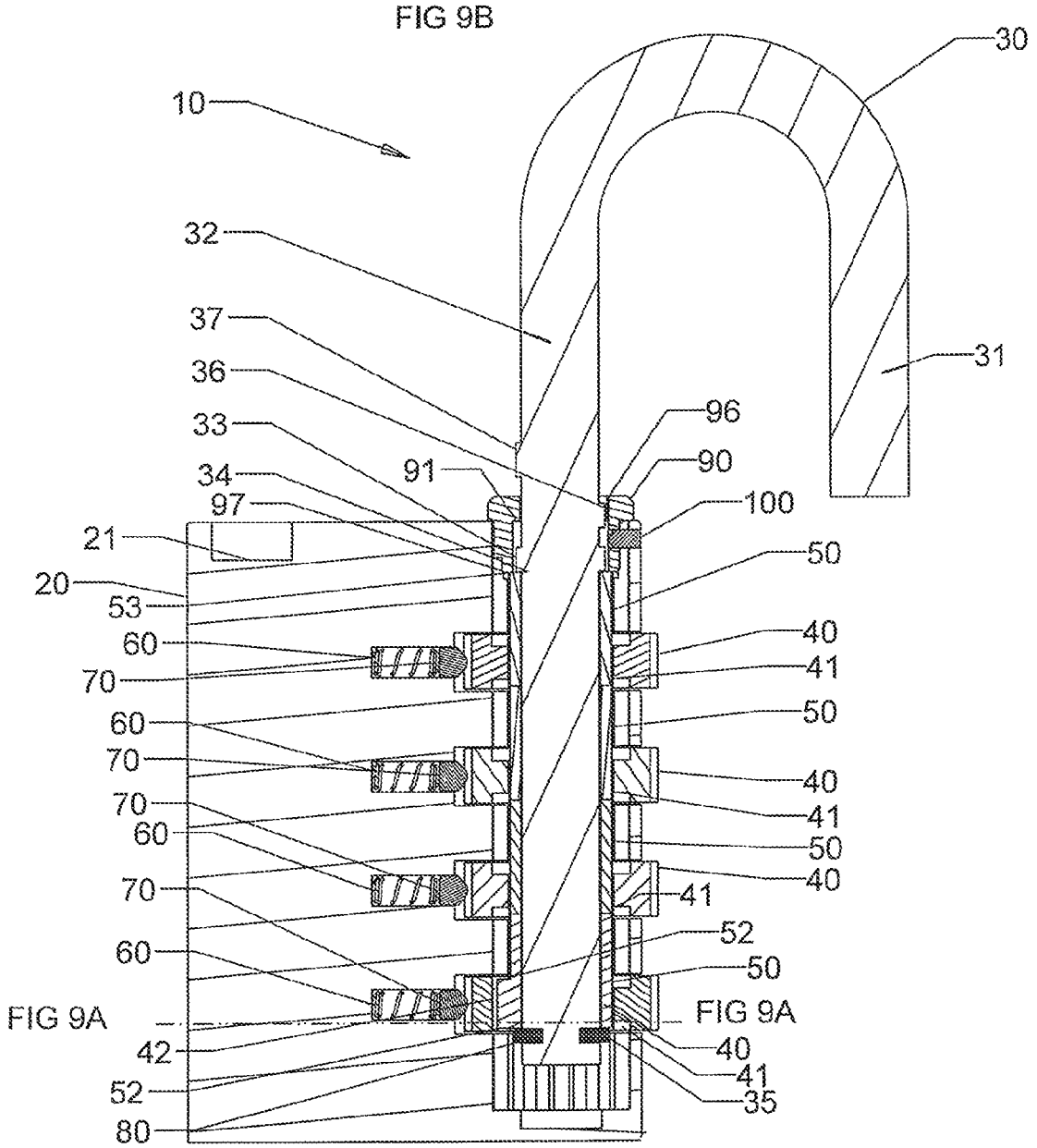
FIG. 9B is a cross sectional front view of the lock showing the shackle located in the lock body when the lock is in the reset mode.

Reset Mode FIG. 9A-9B:

When the lock is in the lock open mode, the short leg 31 of the shackle 30 is released from the locking hole 21 and the alignment protrusion 37 of the long leg 32 of the shackle 30 is disengaged from the ring slot 96. As such, the user can rotate the shackle 30 relative to the lock body 20. When the shackle 30 is rotated by a predetermined angle, such as 180 degrees, the reset-protrusion 36 of the shackle 30 is aligned with the ring slot 96, allowing the user to pull the shackle 30 further upward until the top surface 53 of the top clutch 50 contacts the bottom surface 97 of the top sealing cap 90. As the shackle 30 is pulled further upward, the reset-protrusion 36 of the shackle 30 is al least partly located in the ring slot 96, preventing the shackle 30 from rotating relative to lock body 20. As such, the user would realize that the lock 10 is now in the reset mode. When the shackle 30 is pulled upward, the clutches 50 are also pulled along and the protrusion 52 of each of the clutches 50 is effectively disengaged from the notch 23 of the lock body 20. Since the protrusion 52 of each of the clutches 50 is engaged with the open slot 42 of a dial 40, the user can turn the clutches 50 to change the combination by turning the dials 40.

After the user selects a desired combination, the user may push the shackle back to the locking position by pushing the shackle downward until the reset-protrusion 36 of the shackle 30 is disengaged from the ring lot 96 of the top sealing cap 90, and then rotating the shackle 30 back to the lock open position.

As shown in FIG. 3, the alignment protrusion 37 of the long leg 32 of the shackle 30 is adjacent to the reset protrusion 36, further away from the limiting protrusion 33. As shown in FIG. 1B, when the lock 10 is operated in the lock position, the alignment protrusion 37 is located in the ring slot 96 on the partial ring 92 the top sealing cap 90. As shown in FIGS. 8B, when the lock 10 is operated in the open position, the alignment protrusion 37 is disengaged from but still aligned with the ring slot 96 of the top sealing cap 90. When the shackle 90 is rotated away from the open position, the misalignment between the alignment protrusion 37 of the shackle 30 and the ring slot 96 on the partial ring 92 of the top sealing cap 90 prevents the shackle 30 from being pushed downward. Thus, in order to push the shackle 30 downward, the shackle 30 must be returned to the open position as shown in FIG. 8B. As the shackle 30 is being pushed downward, the protrusion 52 of the clutch 50 will start to engage back to the notch 23 of the body. As the user places the short leg 31 of the shackle 30 back to the lock hole 21, turning of the dials 40 will cause the open slot 42 of the dial 40 to misalign with the protrusion 52 of the clutch and the lock 10 is now again in the lock position.

The design of the notch 23 of the lock body will allow each number/words/marking on the dial 40 to have a designated notch 23 to allow the protrusion 52 of the clutch 50 to engage with the designated notch. This means that if the dial has ten markings "0-1-2-3-4-5-6-7-8-9" then the lock body will have ten notches 23 to allow the protrusion 52 of the clutch 50 to engage. It should be noted that the markings can also be alphabetical letters or Chinese characters or signs.

The present invention has been disclosed as a combination lock having a lock body 20 having a body portion to house the long leg 32 of the shackle 30 along with a plurality of dials 40 and clutches 50 to control the movement of the long leg 32. The lock body 20 also has a lock hole 21 to receive the short leg 31 of the shackle 30 when the lock is in the lock mode. Each of the dials 40 is rotatably mounted on a different one of clutches 50 to form a dial-clutch pair. The body portion comprises a plurality of separation sections 24 and a plurality of gaps 28, each of the gaps is arranged to accommodate a dial 40 and each of the separation sections 23 has a channel 22 dimensioned to receive a clutch 50. Each of the gaps 28 and an adjacent separation section 24 are associated with a dial-clutch pair. Each of the clutches 50 has a protrusion 52 and each of dials 40 has an inner ring 43 with an inner diameter to receive a clutch 50 and an open slot 42 dimensioned to receive the protrusion 52 of a clutch 50. A clutch 50 has a first segment and a second segment having the protrusion 52. When the lock is operated in the lock mode, the second segment of the clutch 50 is located in the separation section 24 and the first segment of the clutch 50 is located in the gap 28. As such, in a dial-clutch pair, the dial 40 is disengaged from the protrusion 52 of the clutch 50, allowing the dial 40 to rotate relative to the clutch 50. Each of the channels 22 has a plurality of channel notches 23 such that the protrusion 52 of a clutch 50 is at least partly engaged in one of the channel notches 23 when the lock is in the lock mode or in the open mode. As such, the clutch 50 is prevented from rotating relative to long leg 32 of the shackle 30. Each of the dials 40 also has one or more faulty or dial notches 41. Each of the faulty notches 41 has a notch length smaller than the thickness of the dial 40 and each of the faulty notches 41 is aligned with a channel notch 23 in the separation section 24 located below the dial 40. The long leg 32 of the shackle 30 has a limiting protrusion 33 spaced from the neck cut-out 35 at the shackle end to accommodate the plurality of clutches 50 such that when the long leg 32 of the shackle 30 is caused to move in a vertical movement, the plurality of clutches 50 are also caused to move along with the shackle.

When the lock is in the lock mode, the protrusion 52 of the clutch 50 in at least one of the dial-clutch pairs is misaligned with the open slot 42 of the dial 40. As such, when the long leg 32 of the shackle 30 is pulled upward while the lock is in the lock mode, the protrusion 52 of the clutch 50 in that one of the dial-clutch pair is caused to move into one of the faulty or dial notches 41 of the dial 40, preventing the dial 40 from rotating relative to the clutch 50.

When the lock is in the lock mode and a user rotate the dials according to the combination code, the protrusion 52 of the clutch 50 in each of the dial-clutch pair is aligned with the open slot 42 of the dial 40, the long leg 32 of the shackle 30 can be pulled upward to release the short leg 31 of the shackle 30 from the lock hole 21 to prompt the lock to operate in the open mode. However, the upward movement of the shackle 30 is limited by a reset-protrusion 36 which is blocked by the ring surface 91 of the partial ring 92 of the cap 90. As such, the protrusion 52 of the clutch 50 in each of the dial-clutch pairs is located in the open slot 42 of the dial 40, preventing the dial 40 from rotating relative to the clutch 50 and also preventing the protrusion 52 of the clutch 50 from completely moving out of the engaging channel notch 23. Thus, when the lock is operated in the open mode, the dials cannot turn.

To turn the dials to reset the combination, the user must rotate the shackle 30 away from the lock open position so that the reset protrusion 36 aligns with ring slot 96 on the partial ring 92 of the cap 90. The user can now pull the long leg 32 of the shackle 30 further upward so as to release the protrusion 52 of each of the clutches 50 from the channel notches 23. The user may turn one or more of the dials 40 along with the clutches 50 in the dial-clutch pairs to change the combination code.

Having the open slot 42 and the faulty notches 41 on a dial 40 has the advantage of making picking the combination lock more difficult, and also has the benefit of reducing the manufacturing cost of the dials.

As disclosed, the dial may have ten markings of "0-1-2-3-4-5-6-7-8-9" and the clutch may have ten notches 23 to form a combination code. It is understood that the number of markings can be different from ten and the combination code can be formed from different signs or characters.

Thus, although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A combination lock operable at least in a lock mode and an open mode, the combination lock comprising:

a lock body;

a shackle having a long leg and a short-leg;

a stack of clutches, each clutch having a hole defining an inner surface and a protrusion on an outer surface, the hole arranged to receive the long leg of the shackle; and a plurality of dials rotatably mounted on the stack of the clutches to form a combination code, each of the dials arranged to mount on a different one of the clutches to form a dial-clutch pair, wherein the lock body comprises a body portion to house the long leg of the shackle and a lock hole spaced from the body portion arranged to receive the short leg of the shackle when the lock is operated in the lock mode, the body portion comprising a plurality of separation sections and a plurality of gaps separating the separation sections, wherein each of the gaps and one of the adjacent separation sections are associated with a dial-clutch pair, and wherein the dial comprises an inner ring, the inner ring having an inner diameter to receive the clutch and a single open slot dimensioned to receive the protrusion of the clutch at least when the lock is operated in the open mode.

2. The combination lock according to claim 1, wherein, in each of the dial-clutch pairs, the clutch has a first segment and a second segment having the protrusion, and wherein when the lock is in the lock mode, the dial is located in the first segment of the clutch such that the protrusion of the clutch in each of the dial-clutch pairs is effectively disengaged from the dial, allowing the dial to rotate relative to the clutch.

3. The combination lock according to claim 2, wherein the gap is dimensioned to accommodate a dial, and the separation section comprises a channel dimensioned to receive a clutch such that, in each of the dial-clutch pairs, the first segment of the clutch is located in the gap and the second segment of the clutch is located in the separation section when the lock is operated in the lock mode.

4. The combination lock according to claim 3, wherein the long leg of the shackle has a longitudinal axis and wherein the channel comprises a plurality of channel notches, such that the protrusion of the clutch is at least partly located in one of the channel notches when the lock is operated in the lock mode or operated in the open mode, preventing the clutch from being rotated about the longitudinal axis of the long leg of the shackle.

5. The combination lock according to claim 4, wherein the dial has a thickness and the open slot is made through the thickness, and wherein the dial further comprises on the inner ring a plurality of dial notches facing the second segment of the clutch, each dial notch having a notch length smaller than the thickness, wherein each of the dial notches is arranged to align with a channel notch of the channel in the separation section where the second segment of the clutch is located.

6. The combination lock according to claim 5, wherein the long leg of the shackle comprises a shackle end and a limiting protrusion spaced from the shackle end, the limiting protrusion is so located as to accommodate said stack of clutches between the limiting protrusion and the shackle end such that the stack of clutches is caused to move along the shackle when the long leg of the shackle is caused to move along the longitudinal axis.

7. The combination lock according to claim 6, wherein when the lock is operated in the lock mode, the protrusion of the clutch in at least one of the dial-clutch pairs is misaligned from the open slot of the dial.

8. The combination lock according to claim 7, wherein the body portion has a first end and an opposing second end adjacent to the shackle end of the long leg of the shackle, and wherein when the shackle is caused to move in a first direction along the longitudinal axis away from the second end of the body portion when the lock is operated in the lock mode, the protrusion of the clutch in said at least one of the dial-clutch pairs is caused to move into one of the dial notches of the dial, preventing the dial from rotating relative to the clutch.

9. The combination lock according to claim 6, wherein when the protrusion of the clutch in each of the dial-clutch pairs is aligned with the open slot of the dial, the protrusion can be caused to move into the open slot such that the long leg of the shackle can be caused to make a movement in the first direction to cause the short leg of the shackle to disengage from the lock hole of the lock body, prompting the lock to operate in the open mode.

10. The combination lock according to claim 9, wherein the lock body further comprises a cap located on the first end of the body portion, the cap comprising a partial ring dimensioned to receive the long leg of the shackle, the partial ring having a ring surface facing the second end of the body portion, and wherein the long-leg of the shackle further comprises a reset-protrusion adjacent to the limiting protrusion further away from the shackle end, the reset-protrusion is arranged such that when the lock is operated in the open mode, the movement of the long-leg of the shackle in the first direction is limited by contacting between the reset-protrusion of the shackle and the ring surface of the partial ring, thereby preventing the protrusions of the clutches from disengaging from the channel notches.

11. The combination lock according to claim 10, wherein the partial ring further comprises a ring slot dimensioned to receive the reset-protrusion of long leg of the shackle, and wherein, when the lock is operated in the open mode, the long leg of the shackle can be caused to rotate about the longitudinal axis so as to align the reset-protrusion with the ring slot of the partial ring such that the long leg of the shackle can be caused to make a further movement in the first direction to allow the protrusions of the clutches to disengage from the channel notches.

12. The combination lock according to claim 11, wherein when the protrusions of the clutches are disengaged from the channel notches, the dials together with the clutches can be caused to rotate independently for changing the combination code.

13. The combination lock according to claim 11, wherein the first end of the body portion further comprises a plurality of first end notches, and the cap further comprises one or more keys dimensioned for insertion into one or more first end notches so as to locate the ring slot on the first end of the body portion.

14. The combination lock according to claim 11, wherein the long-leg of the shackle further comprises an alignment protrusion adjacent to the reset-protrusion further away from the limiting protrusion, the alignment protrusion is arranged such that when the lock is operated in the lock mode, the alignment protrusion is located in the ring slot of the partial ring, and when the long leg of the shackle is caused to make the movement in the first direction to disengage the short leg of the shackle from the lock hole of the lock body, the movement in the first direction also releases the alignment protrusion from the ring slot of the partial ring.

15. The combination lock according to claim 14, wherein after the protrusions of the clutches have been disengaged from the channel notches, the long leg of the shackle is prevented from moving a second direction opposite to the first direction unless the alignment protrusion of the long leg of the shackle is aligned with the ring slot of the partial ring.

* * * * *